United States Patent [19]

Geiger

[11] 3,955,614

[45] May 11, 1976

[54] FOUNDRY MOLDING MACHINE

[75] Inventor: Werner Geiger, Meggen, Switzerland

[73] Assignee: Inventio AG, Hergiswil, Switzerland

[22] Filed: July 7, 1975

[21] Appl. No.: 593,452

[30] Foreign Application Priority Data

July 10, 1974 Switzerland ..... 9490/74
June 18, 1975 Switzerland ..... 7895/75

[52] U.S. Cl. ..... 164/210; 164/162; 164/29; 164/207

[51] Int. Cl.[2] ..... B22C 15/02; B22C 13/02; B22C 9/00

[58] Field of Search ..... 164/29, 162, 168, 181, 164/183, 184, 207, 210, 212, 224

[56] References Cited

UNITED STATES PATENTS

| | | | |
|---|---|---|---|
| 2,325,501 | 7/1943 | Gedris | 164/162 |
| 3,730,250 | 1/1973 | Fellows | 164/29 |

FOREIGN PATENTS OR APPLICATIONS

| | | | |
|---|---|---|---|
| 839,866 | 6/1960 | United Kingdom | 164/210 |
| 1,147,675 | 6/1957 | France | 164/210 |
| 520,080 | 3/1955 | Italy | 164/210 |

*Primary Examiner*—Harrison L. Hinson
*Attorney, Agent, or Firm*—Werner W. Kleeman

[57] ABSTRACT

A foundary molding machine which for the simultaneous separate production of two foundry mold parts possesses two mold units provided with a respective match plate support and a sand filling- and compaction station. Each of the mold units has operatively associated therewith a pivotal device incorporating pivotal arms pivotable about vertical shafts in a respective horizontal plane. The pivotal arms carry mold frames supported in mold frame holders which they pivot from the sand filling- and compaction station, while rotating the mold frame containing the mold lower part through 180° about a horizontal axis, into a position wherein both mold parts are in superimposed position at an attachment or assembly station where both of the mold parts are deposited on top of one another onto a conveyor mechanism. According to the invention, each pivotal device possesses at least three substantially uniformly offset pivotal arms carrying the mold frames in the mold frame holders and all mold frames of both pivotal devices are rotatable about a respective horizontal shaft through an angle of approximately 180° and arranged to be individually vertically displaceable.

10 Claims, 7 Drawing Figures

FOUNDRY MOLDING MACHINE

BACKGROUND OF THE INVENTION

The present invention relates to a new and improved construction of a foundry molding machine —hereinafter sometimes conveniently simply referred to abbreviately as a molding machine— as well as to the use of such molding machine, and which molding machine for the separate simultaneous production of two mold parts possesses two mold units provided with a respective match plate support and a sand filling- and compaction station, the mold units have associated therewith a respective pivoting device incorporating pivotal arms pivotable about substantially vertical shafts in a respective substantially horizontal plane, the pivotal arms carrying mold frames in mold frame holders, and the pivotal arms pivoting the mold frames from the sand filling- and compaction station while rotating the mold frame containing the lower part of the mold through 180° about a substantially horizontal axis into a superimposed position of both mold parts at an assembly or attachment station where both of the mold parts are deposited on top of one another onto a conveyor device or mechanism.

Such general type foundry molding machine has been taught in U.S. Pat. No. 2,325,501. The mold frame holders are constructed as rectangular pivotal frames which at both of their ends engage about the mold frames, the pivotal frames being mounted at a stand or upright to be vertically displaceable at the center of the rectangle and pivotable about the vertical shaft or axis. In the pivotal frames containing the lower part of the mold the mold frames are held in a rotatable frame which is rotatable about a horizontal axis. The mold frames are detachably connected by means of an electromagnetic coupling with the pivotal frames or rotatable frames respectively. This molding machine possesses a number of different drawbacks. The insertion of cores and controlling mold faults or defects can be only carried out with great difficulty with regard to the upper part of the mold. During lowering of the mold-upper part onto the mold-lower part the pivotal frames are also simultaneously lowered onto the mold table. Due to tolerances there thus exist inaccuracies. The utilization and covering of the mold frames is complicated and slows down the working speed of the machine. Also the use of two pivotal frames offset from one another through an angle of 90° does not result in any appreciable improvement in the working speed for the contemplated mode of operation. Moreover, the machine is not suitable for boxless molds.

In French patent No. 1,147,675 there is disclosed a similar foundry molding machine wherein according to a first exemplary embodiment for a boxless mold mold parts are lowered in succession onto a stationary conveyor belt and an ejection plate mounted from above onto the mold parts fixedly holds the mold parts, whereas the mold frames are vertically raised from the mold parts. There are provided two telescopic columns each having a pivotal arm supported at the end of a mold frame, each such pivotal arm can be pivoted back and forth through an angle of 180°. The pivotal arm carrying the lower part of the mold is rotatable about its horizontal axis through an angle of 180°. Once again this machine also possesses the drawback that the insertion of cores and checking for mold defects at the upper part of the mold is difficult. Also, with this arrangement there must be tolerated very small operating or working speeds since for each telescopic column there is only provided one pivotal arm. The provision of more than one pivotal arm is not possible owing to the contemplated arrangement of the sand filling- and compaction station and the guide rails for the vertical guiding of the mold frames.

Both state-of-the-art molding machines possess the drawback that they are not suitable for producing molds composed of three or more mold parts.

SUMMARY OF THE INVENTION

With the foregoing in mind it is a primary object of the present invention to provide an improved construction of foundry molding machine which is not associated with the aforementioned drawbacks and limitations of the prior art constructions.

Another and more specific object of the present invention aims at the provision of a new and improved construction of molding machine permitting of a high working or operating speed, the insertion of cores and checking mold defects for all mold parts in a simple and reliable manner, and which is also suitable for producing molds composed of three or more mold parts.

Now in order to implement these and still further objects of the invention, which will become more readily apparent as the description proceeds, the molding machine of this development is manifested by the features that each pivotal device possesses at least three substantially uniformly offset pivotal arms carrying mold frames in mold frame holders, and all mold frames of both pivotal devices are rotatable through an angle of approximately 180° about a respective horizontal axis and are arranged to be individually vertically displaceable.

A further object of the invention is the use of the molding machine of this development for producing boxless or flaskless foundry molds.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE INVENTION

Figure 1:
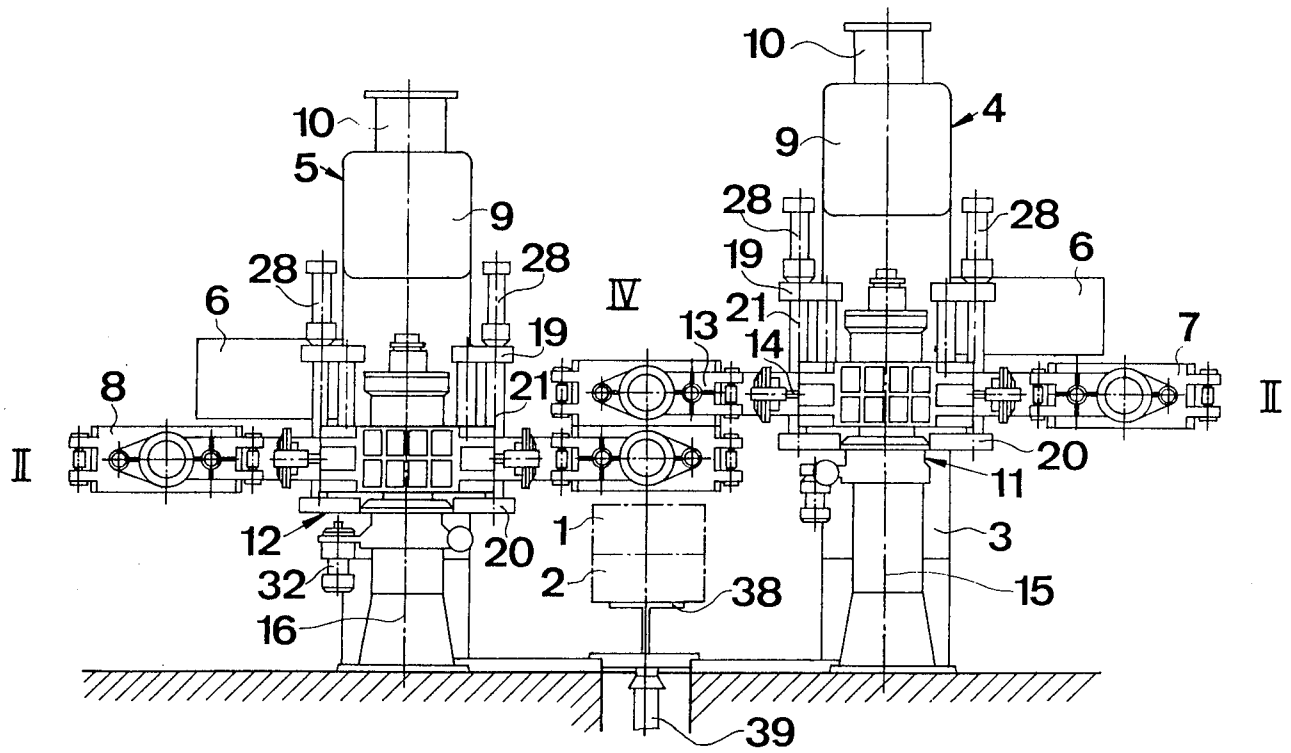
FIG. 1 is a front view of a molding machine for producing two-part boxless foundry molds.
Figure 2:
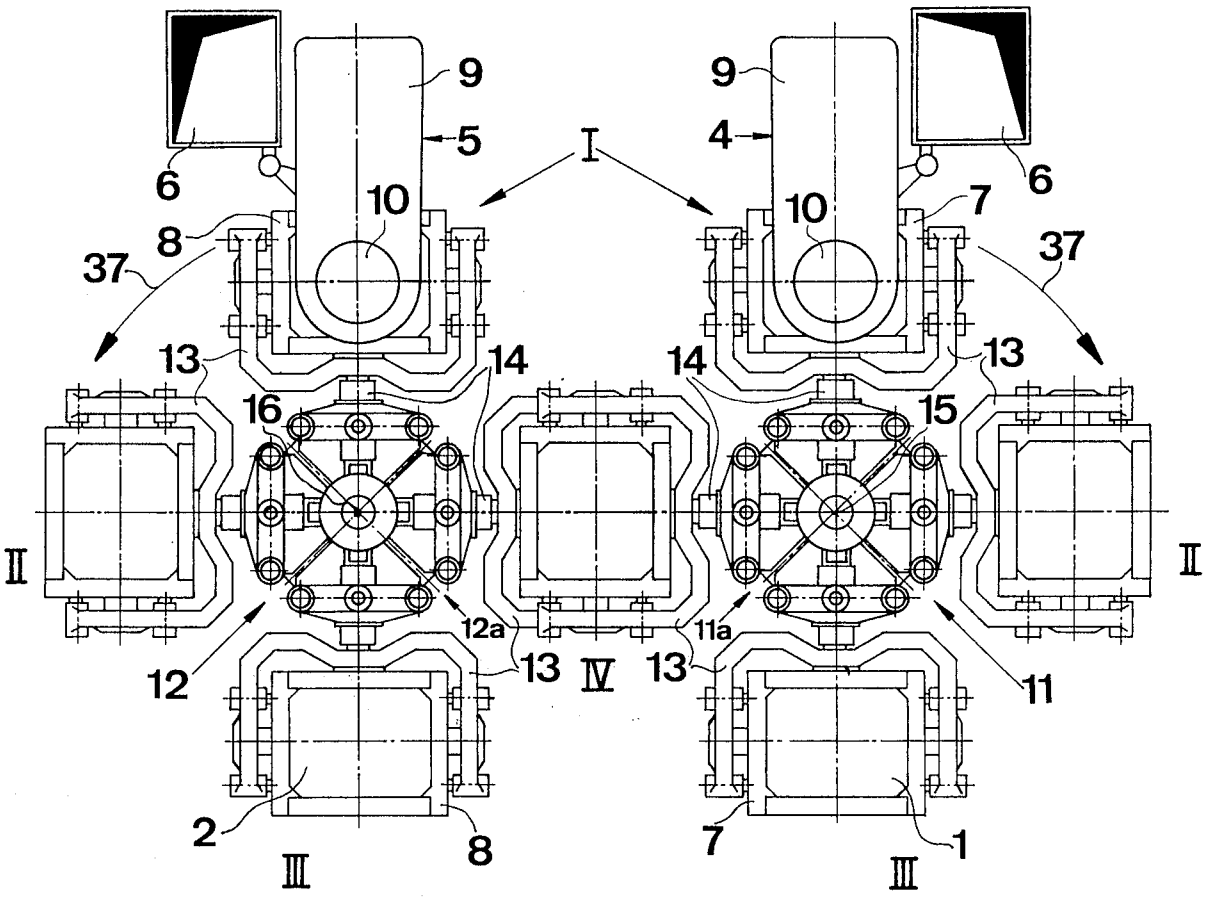
FIG. 2 is a plan view thereof.
Figure 3:
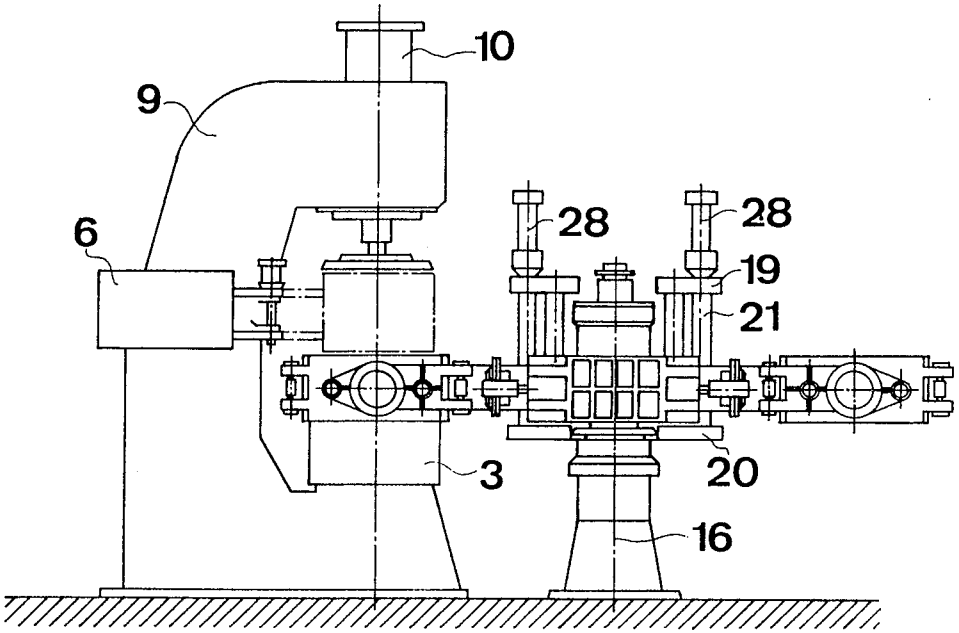
FIG. 3 is a side view of the molding machine illustrated in FIG. 1.

Describing now the drawings, the exemplary embodiment of foundry molding machine illustrated in FIGS. 1, 2 and 3 and serving for the separate and simultaneous production of a boxless foundry mold composed of a mold upper part or component 1 and a mold lower part or component 2 possesses at a sand filling- and compaction station I two analogous mold units 4 and 5.

Each mold unit 4 and 5 essentially consists of a pattern or match plate support 3 carrying a single-face match plate, a sand dosing silo or hopper 6 for dosing a quantity of sand which is to be filled into the mold frames 7 and 8 respectively, and a press or squeezing cylinder 10 arranged at a press stand or housing 9 for the compaction of the sand filled into the corresponding mold frames 7 and 8 respectively.

Each mold unit 4 and 5 has associated therewith a pivoting or pivotal device 11 and 12 possessing a four-arm rotary rim or turnstile 11a and 12a, respectively. Each pivotal device 11 and 12, in the exemplary embodiment under discussion, possesses four pivotal arms 14 each carrying a respective mold frame holder 13. At the pivotal devices 11 and 12 the pivotal arms 14 are each conjointly pivotable about a vertical shaft or axle 15 and 16, respectively. In the mold frame holders 13 of the pivotal or pivoting device 11 there are arranged the mold frames 7 for the reception of the corresponding mold-upper part 1 and in the mold frame holders 13 of the pivotal or pivoting device 12 there are arranged the mold frames 8 for the reception of the corresponding mold-lower part 2. The pivotal arms 14 of both pivotal devices 11 and 12 are each located in substantially vertically offset substantially horizontal planes, the vertical shafts 15 and 16 being spaced from one another in such a manner that a mold frame 7 of the pivotal device 11 is located exactly over a mold frame 8 of the pivotal device 12 when for each pivotal device 11 and 12 a mold frame 7 and 8 of the corresponding mold unit 4 and 5, respectively, is located in the sand filling- and compaction station I.

Figure 4:
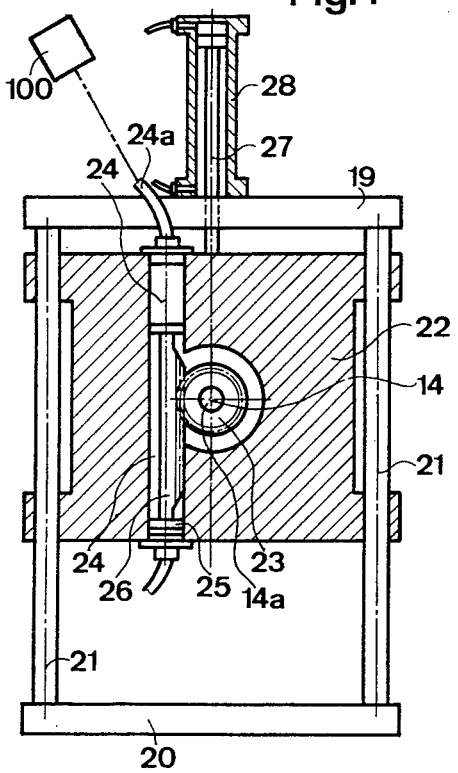
FIG. 4 is a sectional view illustrating a detail thereof.
Figure 5:
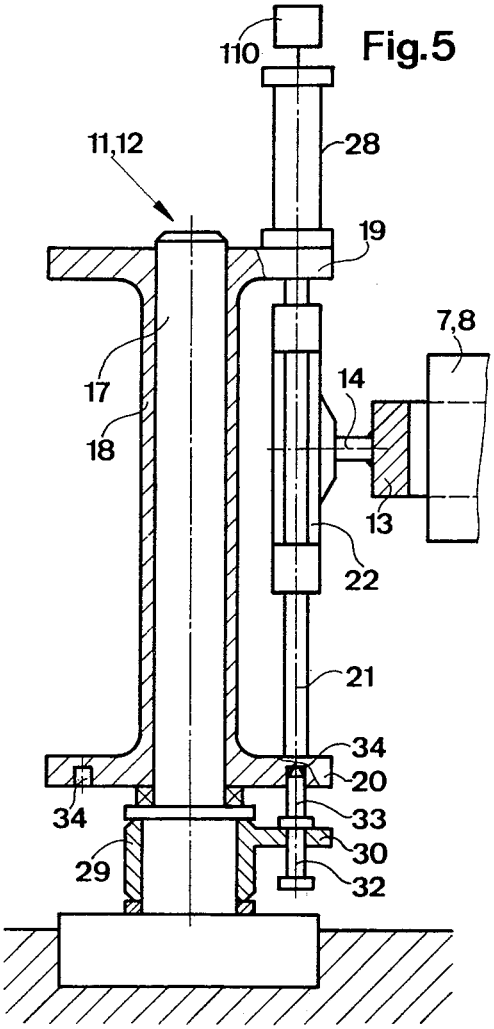
FIG. 5 is an elevational sectional view of a further detail thereof.
Figure 6:
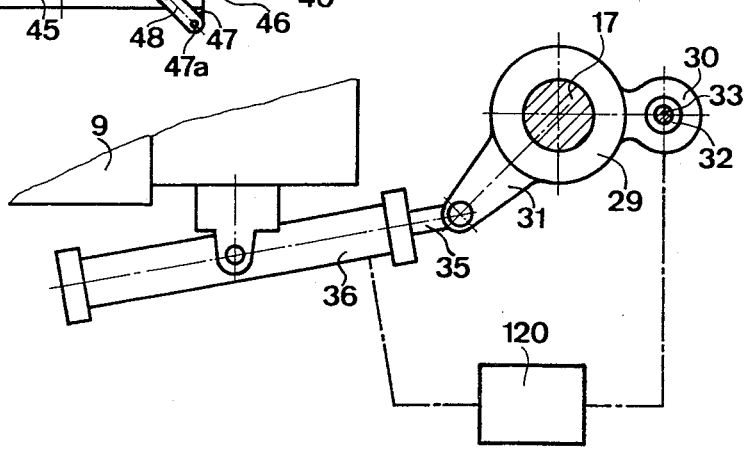
FIG. 6 is a fragmentary plan view partially illustrated in section of a pivotal or pivoting device with a pivotal arm.

As for instance shown by way of example in FIGS. 4, 5 and 6 the mold frame holders 13 together with the mold frames 7 and 8 attached therein are each individually vertically displaceable and arranged to be rotatable through 180° about a horizontal axis at the pivotal arms 14. Each pivotal or pivoting device 11 and 12 consists of a stationary shaft 17 anchored at the floor or other supporting surface at which there is mounted a rotatable bushing or sleeve 18 having an upper flange 19 and lower flange 20. Between the flanges 19 and 20 there are secured in spaced relationship from one another two vertical guide rods 21 serving to guide a bearing plate 22. Rotatably mounted in the bearing plate 22 is a shaft 14a forming a pivotal arm 14 and at which there is appropriately attached the mold frame holder 13. A gear 23 is seated upon the shaft 14, this gear 23 cooperating in meshing engagement with a gear rack 26 provided at both ends with pistons 25 guided in hydraulic cylinders 24. In FIG. 4 one such piston 25 is visible at the lower end of the gear rack 26 and at the upper end thereof there is visible one such cylinder 24. Both of the cylinders 24 are connected via the conduits or lines 24*a* to a schematically illustrated conventional hydraulic control unit 100. Upon actuation thereof the gear rack 26 is displaced and thus rotates the associated mold frame holder 13 with the mold frames 7 or 8, respectively, through an angle of approximately 180°. At the bearing plate 22 there is secured the piston rod 27 of a hydraulic piston-cylinder unit 28 attached in any convenient fashion to the flange 19. The piston-cylinder unit 28 is likewise connected with a suitable hydraulic control unit, schematically indicated by reference character 110, and when actuated displaces the bearing plate 22 along the guide rods 21 in vertical direction.

Continuing, in FIGS. 5 and 6 there is furthermore illustrated a possible constructional embodiment of drive for the pivotal devices 11, 12. A rotatable ring or ring member 29 is rotatably mounted upon the shaft 17, this rotatable ring 29 possessing two arms or arm members 30, 31 (FIG. 6). In the arm member 30 there is secured in substantially vertical position a hydraulic piston-cylinder unit 32, the piston rod 33 of which can be extended upwardly and thus engages into one of four holes or bore 34 angularly offset with respect to one another through an angle of about 90° and provided at the lower flange 20 of the rotatable bushing or sleeve 18 (FIG. 5). At the other arm 31 there is hingedly mounted or articulated the piston rod 35 of a substantially horizontally arranged hydraulic piston-cylinder unit 36 which is preferably mounted to be pivotable at the press stand or upright 9. Both of the piston-cylinder units 32 and 36 are connected to a merely schematically illustrated common hydraulic control unit 120. In order to carry out the pivotal movement of the pivotal device 11 or 12 respectively, with the piston rod 35 initially retracted there is ejected the piston rod 33 which then operatively couples the rotary or rotatable sleeve or bushing 18 with the rotatable ring 29. Then the piston rod 35 is ejected to such an extent that the rotatable ring 29 carries out a pivotal movement through an angle of about 90°. Thereafter, the piston rod 33 is initially retracted and thereafter the piston rod 35, so that the rotatable ring 29 is rocked back through 90° without entraining the rotatable bushing or sleeve 18.

Having had the benefit of the foregoing discussion there will be now considered the mode of operation of the foundry molding machine illustrated in FIGS. 1 to 6 which is as follows: A mold frame 7 or 8 respectively arriving at the mold unit 4 and 5 respectively, is initially lowered over the match plate onto the match plate support 3 by actuating its associated piston rod 27. After completion of the sand filling- and compression or squeezing operation the filled mold frame 7 or 8 respectively, is again raised and rocked or pivoted in a horizontal plane through an angle of approximately 90° in the direction of the arrow 37 by actuating the piston rods 33 and 35 into a first core insertion station II, and both mold frames 7, 8 are rotated through an angle of approximately 180° by means of the mold frame holder 13 by actuating the associated gear rack 26. The side of the mold parts 1 and 2 which are filled are then located at the top, so that they are freely accessible for the insertion of cores and the faultless control or checking of mold defects.

After completion of a further sand filling- and compaction operation in the mold units 4 and 5, respectively, both of the mold frames 7 and 8 are rotated from the first core insertion station II through a further 90° in the same direction to a second core insertion station III, where there is again present the possibility of inserting cores into both mold parts or components 1 and 2. After completion of the next sand filling- and compaction operation in the mold units 4 and 5, respectively, the mold frames 7 and 8 respectively, are rocked or rotated through a further 90° in the direction of the illustrated arrows about the vertical shafts 15 and 16 respectively into an attachment or assembly station IV, this operation occurring during simultaneous rotation of the mold frame 7 containing the mold upper part 1 through 180°. At the assembly station IV the mold frame 7 comes to lie exactly over the mold frame 8.

During such time as there occurs a further sand filling- and compaction operation in each of the mold units 4 and 5, at the assembly station IV the upper mold frame 7 is lowered onto the lower mold frame 8 by actuating the piston rod 27 and the thus completed mold composed of the mold parts 1 and 2 is then separated from the mold frames 7, 8.

In the exemplary embodiment under discussion the separation of the mold parts 1 and 2 from the mold frames 7 and 8 is undertaken by applying a platform 38, by means of a hydraulic piston-cylinder unit 39, to the underside of the lower mold frame 8 and opening the mold frames 7 and 8 in order to release the mold parts 1 and 2 which bear against one another in superimposed fashion. Thereafter, the platform 38 is lowered to such an extent until the upper mold part 1 is located beneath the mold frame 8 and the mold 1, 2 can be transported away in horizontal direction.

Since the mold frames 7 and 8 and the mold frame holders 13 can be individually vertically displaced by means of the associated piston-cylinder units 28, it is possible to advantageously directly lower the mold upon carriage platforms of conveyor chains or upon a conveyor band which is moving incrementally or stepwise, by lowering both mold frames 7, 8, and then after opening and raising the mold frames 7, 8 transporting such away in a conveying step. In this way there is rendered superfluous the provision of a platform 38 provided with the piston-cylinder unit 39.

Figure 7:
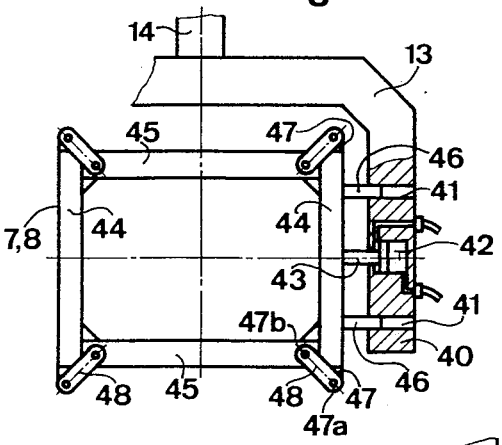
FIG. 7 is a plan view showing details of a variant arrangement of a mold frame inserted into a mold frame holder.

The mold frames 7 and 8 which can be opened and closed can be constructed according to the exemplary embodiment shown in FIG. 7. In FIG. 7 reference character 13 again designates a mold frame holder secured to a pivotal arm 14, this mold frame holder 13 possessing at the two support or carrier arms 40 (only one of which is visible) two respective guide bores 41 and a respective hydraulic piston-cylinder unit 42 with a piston rod 43 protruding out of the interior thereof. Each mold frame 7 and 8 comprises two side plates 44 and two longitudinal plates 45 which in the closed position form a substantially rectangular frame 7 or 8. The side plates 44 are equipped at the outside of the frame with two respective guide bolts 46 which penetrate with their free ends into the guide bores 41 and such side plates further possess at their ends a respective bearing finger or lug 47 which protrudes outwardly past the adjoining or neighboring longitudinal plate 45. At each bearing finger or lug 47 there is pivotably mounted by means of the pivot pin or bolt 47*a* one end of a bracket 48 which is substantially located in the plane of the frame. The other or opposite end of each such bracket 48 is rotatable or pivotably mounted by means of the pivot pin or bolt 47*b* at the neighboring longitudinal palte 45. At the side plates 44 there is furthermore secured one of the respective piston rods 43. Now when this piston rod 43 is retracted due to actuation of the associated piston-cylinder unit 42, then it entrains the associated side plate 44, so that also the longitudinal or lengthwise extending plates 45 are moved towards the outside of the frame through the agency of the brackets 48 and hence the relevant mold frame 7, 8 opens at all sides.

On the other hand, especially in the case of small patterns, it is also possible to construct the boxless molds without frames which can be opened, i.e. with closed match plate frames which preferably are chrome-plated at the inside. In this case there is then required a platform which is to be applied to the upper part of the mold and which fixedly retains the mold when the match plate frames 7, 8 are displaced upwardly.

The proposed foundry molding machine is also suitable for molding with mold boxes. There must then be provided a mold box-infeed station, for instance at the location where, for the embodiment shown in FIGS. 1, 2 and 3, the mold units 4, 5 are located. Such are shifted to the original first core insert station II. The mold boxes are thus, for instance, guided upon a conveyor band to the mold box-infeed station, at that location either engaged and raised by the mold frame which can be opened according to the arrangement of FIG. 7 or by means of a gripper device which only consists of the side plates 44 which can be actuated by means of the piston-cylinder units 42.

According to a preferred exemplary embodiment wherein there is rendered superfluous an additional conveyor band for the infeed of the mold boxes, such are directly infed at the rear half of the platform at which there is deposited at the front half the mold boxes with the finished molds. After, in each instance, the filled boxes are deposited and the mold box holders are moved away upwardly, the platform is further displaced through a partial step or increment and the mold box holders are again deposited upon the platform for engaging the mold boxes.

The foundry molding machine with the mold frames 7, 8 which are individually displaceable in vertical direction is also suitable for fabricating three- or multipart molds. In this regard there can be initially deposited a mold-lower part and a mold-intermediate part with mold boxes and then by means of the following pivotal arm 14 of the one pivotal or pivoting device, for instance the device 11, there can be deposited the upper part of the mold. In this respect it is of course necessary that by means of the mold unit 4 there is alternately fabricated a mold-intermediate part and a mold-upper part.

Finally, due to the aforedescribed versatility of the molding machine of the invention, it is to be appreciated that the term "frame" is used in a broader sense to encompass, where applicable, both mold frames and/or mold boxes.

While there is shown and described present preferred embodiments of the invention, it is to be distinctly understood that the invention is not limited thereto, but may be otherwise variously embodied and practiced within the scope of the following claims. Accordingly,

What is claimed is:

1. A foundry molding machine comprising two mold units, each of the mold units being provided with a respective match plate support and a sand filling- and compaction station for the separate simultaneous fabrication of two foundry mold parts, one of the mold parts defining a mold-lower part and the other mold part a mold-upper part, each of the mold units comprising a respective pivotal device possessing pivotal arms which are pivotable about substantially vertical axes in a respective substantially horizontal plane, said pivotal arms being provided with mold frame holders for supporing mold frames which can be rotated from the sand filling- and compaction station while rotating each mold frame containing the mold-lower part through an angle of about 180° about a horizontal shaft into a position where both mold parts are in superimposed position at an assembly station where both mold parts are deposited upon one another onto a conveyor device, the improvement comprising: each pivotal device comprising at least three substantially uniformly offset pivotal arms carrying the mold frames in the mold frame holders, and means for rotating each of the mold frames of both pivotal devices through an angle of about 180° about a respective substantially horizontal axis and means for individually vertically displacing each of the mold frames.

2. The foundry molding machine as defined in claim 1, further including means defining at least one core insert station for each pivotal device.

3. The foundry molding machine as defined in claim 1, wherein there is arranged in each of the mold frame holders a mold frame containing means enabling each of the mold frames to be selectively opened and closed.

4. The foundry molding machine as defined in claim 1, wherein said rotating means and said vertically displacing means for each mold frame comprises a bearing plate for each mold frame holder, each said mold frame holder being mounted via its associated pivotal arm in said bearing plate for rotation about the horizontal axis of such pivotal arm, vertical guide rods, a stationary substantially vertical shaft, the bearing plate being displaceably guided at the vertical guide rods, said vertical guide rods being secured between an upper flange and a lower flange of a rotatable sleeve mounted to be rotatable about said stationary vertical shaft.

5. The foundry molding machine as defined in claim 4, including a gear rack mounted at said bearing plate, drive means for displacing said gear rack, a gear secured at the pivotal arm supported by said bearing plate, said gear rack being in meshing engagement with the gear secured at the pivotal arm for rotating the associated mold frame holder.

6. The foundry molding machine as defined in claim 4, including a rod connected with the bearing plate, drive means for actuating said rod, said drive means being mounted at one of the flanges of the rotatable sleeve, said bearing plate being connected with the rod for substantially vertical displacement along the guide rods.

7. The foundry molding machine as defined in claim 4, said pivotal arms of each pivotal device being angularly offset with respect to one another, a rotatable ring rotatably mounted at said vertical shaft, a rod member carried by the rotatable ring, one of the flanges of the rotatable ring being provided with recesses, means for displacing said rod member into one of said recesses for coupling the rotatable ring with the rotatable sleeve, drive means for rotating the rotatable ring through a predetermined angular rotation, said angular rotation corresponding to said angular offset of the pivotal arms of the pivotal device, and the recesses are arranged in the same number and the same angular offset position as the pivotal arms.

8. The foundry molding machine as defined in claim 1, wherein for fabricating boxless foundry molds each mold frame comprises two oppositely situated side plates and two oppositely situated longitudinal plates assembled together into a substantially rectangular structure, a pivotably mounted bracket for connecting each longitudinal plate with a neighboring side plate, means pivotably mounting one end of each such bracket at its associated longitudinal plate and the other end of such bracket at an extension of the neighboring side plate which extends past the rectangular structure, said brackets being located substantially in a plane of the mold frame, and each of two oppositely situated plates are provided with a displacement drive mounted at the associated mold frame holder for opening the mold frame.

9. The foundry mold machine as defined in claim 1, wherein said foundry mold machine is used for fabricating boxless foundry molds.

10. A foundry molding machine comprising two mold units for the simultaneous separate fabrication of at least two mold parts, each mold unit comprising a pivotal device, each pivotal device comprising angularly offset pivotal arms, a mold frame support for a mold frame carried by each pivotal arm, means for rotating each pivotal arm through an angle of about 180° about a substantially horizontal axis, and means for vertically displacing each pivotal arm.

* * * * *